US005864080A

United States Patent [19]

O'Connell

[11] Patent Number: 5,864,080

[45] Date of Patent: *Jan. 26, 1999

[54] SOFTWARE SOUND SYNTHESIS SYSTEM

[75] Inventor: Steven S. O'Connell, Scotts Valley, Calif.

[73] Assignee: InVision Interactive, Inc., Los Gatos, Calif.

[ * ] Notice: The term of this patent shall not extend beyond the expiration date of Pat. No. 5,596,159.

[21] Appl. No.: 672,096

[22] Filed: Jun. 27, 1996

Related U.S. Application Data

[63] Continuation of Ser. No. 561,889, Nov. 22, 1995.

[51] Int. Cl.[6] ..... G10H 1/00; G10H 7/00

[52] U.S. Cl. ..... 84/622; 84/602; 84/615; 84/630; 84/631; 84/645; 84/DIG. 26

[58] Field of Search ..... 84/601–602, 622–625, 84/615, 618, 630–631, 645, DIG. 26

[56] References Cited

U.S. PATENT DOCUMENTS 5,376,752 12/1994 Limberis et al. ..... 84/622
5,703,312 12/1997 Takahashi et al. ..... 84/626

*Primary Examiner*—Jonathan Wysocki
*Assistant Examiner*—Marlon T. Fletcher
*Attorney, Agent, or Firm*—Limbach & Limbach L.L.P.

[57] ABSTRACT

An audio signal processing system including an input circuit for inputting musical instrument digital interface (MIDI) commands in real time over a plurality of channels, a computer including a central processing unit (CPU) supplied with the MIDI commands for simultaneously synthesizing one or more voices for each of the channels in response to the MIDI commands, each of the voices being generated by one or more of a plurality of predefined audio synthesis algorithms executed in software, a random access memory (RAM) for storing digital voice data representative of each of the voices generated by the CPU, an output circuit for audibly reproducing the voices from the digital voice data stored in the RAM, and wherein the CPU, in generating the voices selects the one or more audio synthesis algorithms based on one or more of the following criteria: the external processing demands placed upon the CPU by other operations being performed by the personal computer, a best match, according to predetermined criteria, between the type of voice required and audio synthesis algorithms available to the CPU, and the availability of wavetable voice data to be buffered into the RAM.

8 Claims, 11 Drawing Sheets

SOFTWARE SOUND SYNTHESIS SYSTEM

This is a continuation of application Ser. No. 08/561,889, filed Nov. 22, 1995.

TECHNICAL FIELD

This invention relates to the artificial generation of sounds. More particularly, it relates to a method of synthesizing the sounds of a variety of musical instruments by means of software algorithms executed by a personal computer.

BACKGROUND ART

In general, electronic musical instruments have been used to generate music for a number of years. These instruments generate musical sound by implementing one of a number of synthesis techniques and generally require some specialized hardware dedicated to sound generation. Some of the techniques typically used for musical sound synthesis are: wavetable (i.e. pulse code modulation (PCM) data of actual sounds), frequency modulation (FM), analog and physical modeling.

In the wavetable technique, the waveform of the tone to be generated is stored in a digitized format in a read-only memory (ROM). The digital waveform is retrieved from memory, processed and then converted from a digital format to an analog signal to generate the tone. As shown in FIG. 12, a PCM wavetable algorithm plays a sampled sound 100 into a filter 102 whose output can be modulated in a mixer 104 according to a volume input. The sampled sound may be looped to conserve memory. The sample is started at the beginning (although this can be a modulation destination), and loops between the loop start and loop end while the key is held down. As soon as the key is released, the sample can continue to loop, or play until the end of the sample. The filter is typically a one pole, two pole cascaded, four pole cascaded, or four pole cascaded resonant filter, but could be any type of filter such as a low pass or even a high pass filter. The equation for each pole is: $y[n]=c*x[n]+(1-c)*y[n-1]$, where $y[n]$ is the filter pole output, c is the filter coefficient, and $x[n]$ is the filter pole input. The four pole cascaded resonant filter takes the output of the fourth cascaded section and mixes it back with the filter input to the first pole with a gain: $x\mathbf{0}[n]=input[n]+r*y3\,[n-1]$, where $x\mathbf{0}[n]$ is the input to the first pole filter, $input[n]$ is the main input to the entire filter, and $y\mathbf{3}[n-1]$ is the main output of the entire filter.

In FM synthesis, the tones are obtained by manipulating the modulation and carrier signals to a voltage controlled oscillator (VCO). As shown in FIG. 13, the FM synthesis algorithm uses a pair of oscillators for its basic function. One oscillator (modulator) frequency modulates the other (carrier). With multiple modulator and carrier oscillators and arrangements modulations, many musically interesting sounds are created. The oscillators are typically sine waves, but can be any smooth waveform. They have to be smooth because high-frequency content waveforms create a lot of aliasing when used in FM configurations. The basic FM pair has the left most operator (modulator) frequency modulating the right most operator (carrier), as shown in FIG. 14. Other arrangements are possible, for example, a three-operator version is shown in FIG. 15.

Analog synthesizers use multiple oscillators that can be preselected to produce different waveforms such as triangle, sawtooth or pulse. The outputs of the different oscillators are summed and their combined signal becomes the musical sound. As seen in FIG. 16, the analog model uses three oscillators summed into a one pole, two pole, four pole, and four pole resonant filter. The oscillators are of fixed types: usually sawtooth, triangle, pulse, and noise. The same filter as used in the PCM algorithm can be used. Alternatively, more sophisticated variations of such a filter can be used.

The approach of physical modeling is to model the physical structure of the instrument in software. The tone requested is input to the model for the instrument and the software program generates a digital waveform for the musical signal. Referring to FIG. 17, the basic clarinet model uses a non-linearity to model the clarinet reed and a delay line and one pole filter to model the bore.

For examples of the above techniques, see U.S. Pat. Nos. 4,597,318 (wave generating method), 4,173,164 (FM synthesis), 4,131,049 (wavetable), and 4,018,121 (FM synthesis).

Not all the techniques above are appropriate for all the musical instruments that a user may be wish to synthesize. For example, physical modeling is an excellent way to reproduce the sound of a clarinet. A piano, however, may be more effectively reproduced using wavetables. In addition, the type of sound generated by one technique may be more desirable than others. For instance, the characteristic sound obtained from an analog synthesizer is highly recognizable and, in some cases, desirable.

Because the specific hardware requirements for each technique are different, existing electronic instruments tend to implement only one technique. This limits the range of the musical instruments and tones that the device can satisfactorily reproduce.

Also, the specialized hardware involved generally contributes to existing electronic synthesizers being expensive dedicated use equipment.

The synthesis techniques above can also be accomplished by the use of software algorithms. See U.S. Pat. No. 4,984,276. In some existing systems, a dedicated digital signal processor (DSP) is used to provide the computing power needed to perform the extensive processing required for the sound synthesis algorithms. DSP based synthesizer equipment is also highly specialized and expensive. See U.S. Pat. No. 5,376,752, for example.

With the increased power of the central processing units (CPUS) that are now built into personal computers (PCs), a PC can perform the synthesis algorithms and convert the digital codes to an audio signal with nothing more than the addition of a coder/decoder (CODEC) device. CODECs are already a standard feature of many PCs and are emerging as standard equipment in the designs now entering the PC marketplace.

There is a need to provide a low cost, high quality sound synthesis system at a low cost.

There is a further need to provide a sound synthesis system which is compatible with a wide variety of personal computers and operating systems.

SUMMARY OF THE INVENTION

The above and other objects are achieved by the present invention of an audio signal processing system which includes input means for inputting musical instrument digital interface (MIDI) commands in real time over a plurality of channels, personal computer means including a display means and a central processing means supplied with the MIDI commands for simultaneously synthesizing one or more voices for each of the channels in response to the MIDI commands, each of the voices being generated by one or more audio synthesis algorithms including a wavetable algorithm, a frequency modulation algorithm, an analog algorithm, and a physical model algorithm, random access memory means for storing digital voice data representative of each of the voices generated by the central processing means, and output means for audibly reproducing the voices from the digital voice data stored in the random access memory means. The central processing means, in generating the voices selects the one or more audio synthesis algorithms based on one or more of the following criteria: (a) the external processing demands placed upon the central processing means by other operations being performed by the personal computer, (b) a best match, according to predetermined criteria, between the type of voice required and audio synthesis algorithms available to the central processing means, and (c) the availability of wavetable voice data to be buffered into the random access memory means.

Moreover, in the preferred embodiment, the central processing means, in generating the voices further processes the digital voice data by special effects processing, including one or more of reverberation, spatialization, equalization, and chorusing processing.

The central processing means, in generating the voices, can selectively diminish the complexity of the processing of a selected audio synthesis algorithm as the processing time available to the central processing means diminishes due to processing demands of other operations being performed by it. Selection of which audio synthesis algorithm whose processing complexity is to be diminished can be based on the type of voice to be generated.

The foregoing and other objectives, features and advantages of the invention will be more readily understood upon consideration of the following detailed description of certain preferred embodiments of the invention, taken in conjunction with the accompanying drawings.

DETAIL DESCRIPTION OF THE PREFERRED EMBODIMENT

The present invention is a programmed personal computer 1 that takes advantage of the increased processing power of personal computers (PCs) to synthesize high quality audio signals. It also takes advantage of the greater flexibility of software to implement multiple synthesis techniques simultaneously. In addition, because the software generates music in response to real time command inputs, it implements a number of strategies for graceful degradation of the system under high command loads.

The system is designed to accept a command stream in the industry standard MIDI format. The MIDI interface standard supports up to 16 channels. The command stream for each channel represents the notes from one instrument. MIDI commands program a channel to be a particular instrument or combination of instruments. Once programmed, the note commands for the channel will be played as the instrument or instruments for which the channel has been programmed. However, the channel may be dynamically reprogrammed to be different instruments.

Because the software system can use any of a number of synthesis techniques to emulate an instrument, it can reproduce a piano using waveform synthesis on one channel while reproducing a clarinet on a different channel with physical modeling. Similarly, two or more layered voices on the same channel can be generated with the same technique or using different techniques. And, when the MIDI stream contains a program change for a different instrument, the new instrument voice can be automatically switched to a different synthesis algorithm.

Figure 1:
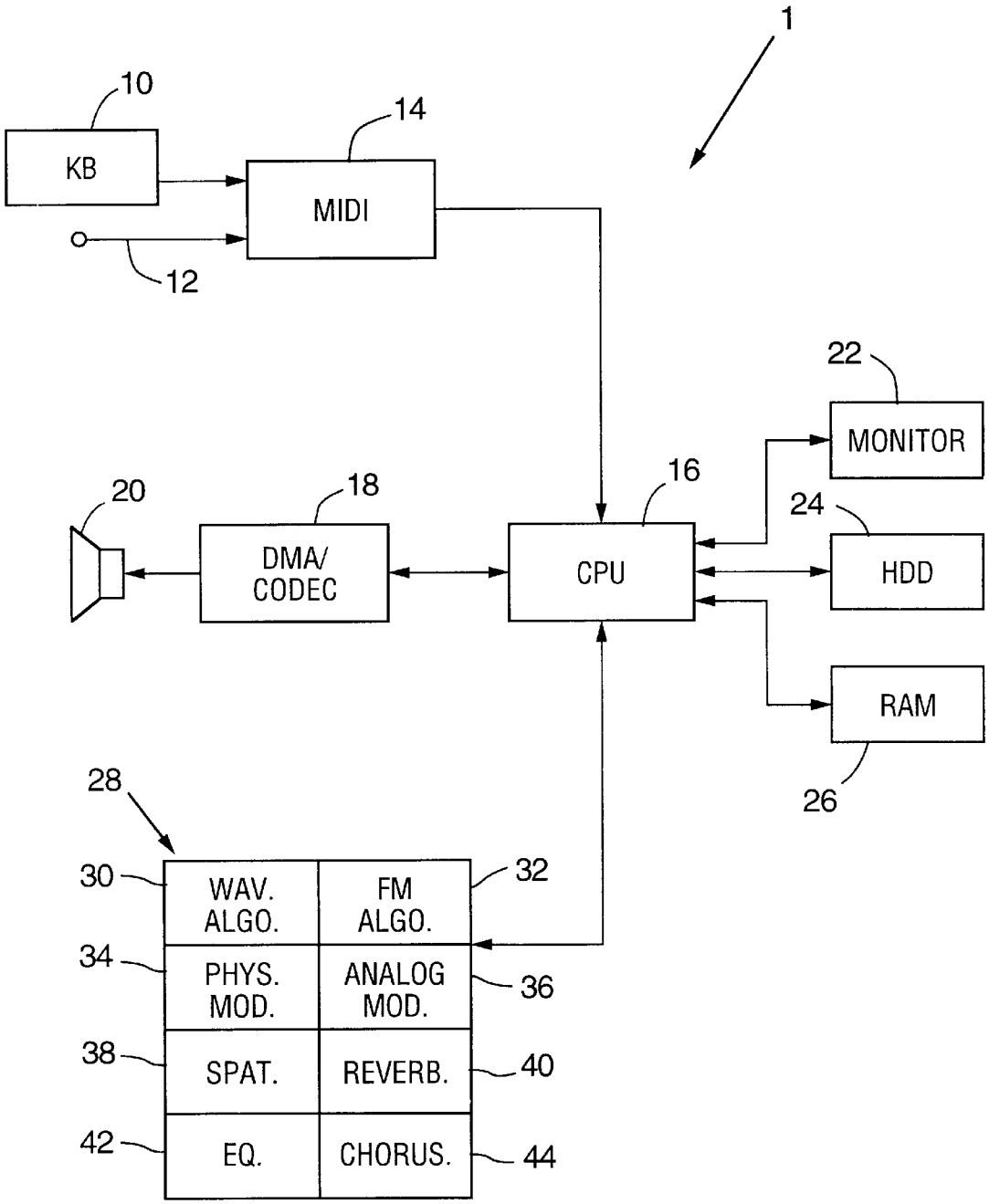
FIG. 1 is a block diagram of a software sound synthesis system according to the present invention.

Referring now to the drawings, in particular FIG. 1, the software sound synthesis system according to the invention is comprised of a MIDI circuit 14 connected to a real time data input device, e.g. a musical keyboard 10. Alternatively, the MIDI circuit 14 can be supplied with voice signals from other sources, including sources, e.g. a sequencer (not shown), within the computer 1. The term "voice "is used herein as a term of art for audio synthesis and is used generally herein to refer to digital data representing a synthesized musical instrument.

The MIDI circuit 14 supplies digital commands in real time asynchronously over a plurality of channels to a central processing unit (CPU) 16 which stores them in a circular buffer. The CPU 16 is connected to a direct memory access (DMA) buffer/CODEC circuit 18 which is connected, in turn, to an audio transducer circuit, e.g. a speaker circuit 20 which is represented in the figure as a speaker but should be understood as representative of a music reproducing system including amplifiers, etc. Also connected to the CPU and controlled by it are a display monitor 22, a hard disk drive (HDD) 24, and a random access memory (RAM) 26.

As will be explained in further detail hereinafter, when the CPU 16 receives a MIDI command from the MIDI circuit 14 designating a particular key or switch on the keyboard 10 which has been depressed by an operator, the CPU 16 synthesizes one or more voices for each of the channels in response to the MIDI commands, each of the voices being generated by one or more audio synthesis algorithms 30 including a wavetable algorithm 28, a frequency modulation algorithm 32, an analog algorithm 36, and a physical model algorithm 34. It is to be understood that although the algorithms 30 are depicted as discrete elements, they are implemented in software. Also, it should be understood that the same algorithm can be used to synthesize voices received on different MIDI channels.

In addition to the basic tone generation described above, the software system is capable of performing real time effects processing using the CPU 16 of the PC rather than the dedicated hardware required by prior art devices. Conventional systems utilize either a dedicated DSP or a custom VLSI chip to produce echo or reverberation ("real time") effects in the music. In the present program, software algorithms are used to produce these effects. The software program can calculate the effects in the CPU 16 of the PC and avoid the additional cost of dedicated hardware. During the effects processing, the digital voice data synthesized by the CPU using the one or more audio synthesis algorithms can be further subjected to spatialization processing 38, reverberation processing 40, equalization processing 42, and chorusing processing 44, for example.

Because the synthesizer process is intended to run in a PC environment, it must coexist with other active processes and is thus limited in the amount of system resources it can command. Furthermore, the user can optionally preset a limit on the amount of memory that the synthesis process may use.

In addition, for some algorithms, such as waveform sampling, the data required to be downloaded from disk in order to generate a tone may be huge, thus introducing significant data transfer delays. Also, the generation of a tone may require a high number of complex calculations, such as for physical modeling or FM synthesis, thus consuming CPU time and incurring delays. The resources required to generate the sound waveform for a command can exceed the processing time available or the tone cannot be generated in the time needed for it to appear to be responsive to the incoming command.

The processing environment and user imposed limits on available resources, as well as the requirements inherent in producing an audible tone in response to a user's keystroke, have led to a series of optimization strategies in the present system which will be discussed in greater detail hereinafter.

Figure 2:
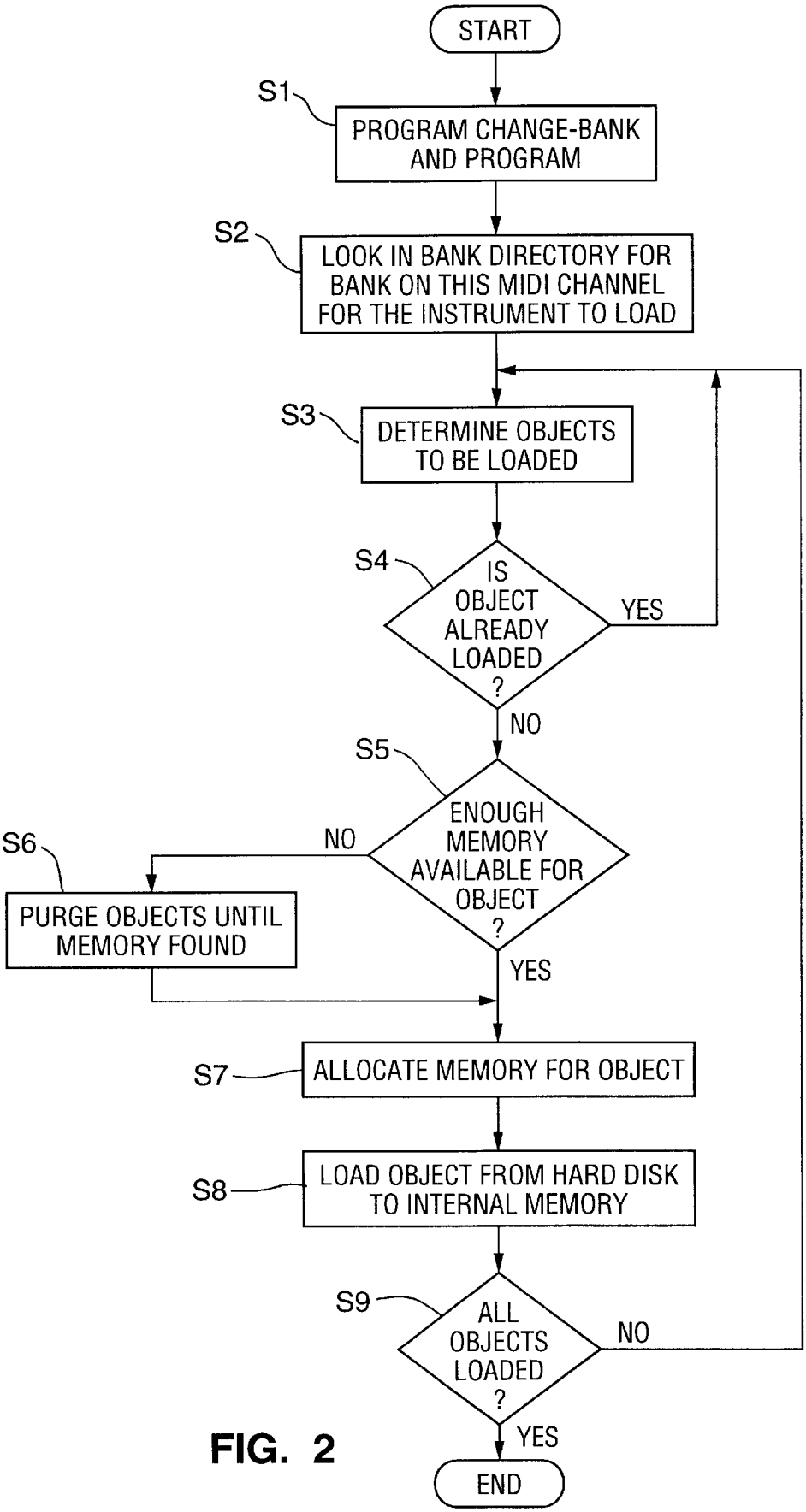
FIG. 2 is a flow chart for a PROGRAM CHANGE AND LOADING INSTRUMENTS routine performed by the central processor shown in FIG. 1.

Referring now more particularly to FIG. 2, the CPU 16 initially executes the PROGRAM CHANGE AND LOADING INSTRUMENTS routine. This routine is normally carried on in background, rather than in real time. At step S1 the CPU 16 loads from the HDD 24 the sound synthesizer program, including some data directory (so-called bank directory) files, into the RAM 26. At step S2, the CPU 16 looks in a bank directory of the data on the HDD 24 for the particular group of instruments specified by a MIDI command received from the MIDI circuit 14. It should be understood that each bank comprises sound synthesis data for up to 128 instruments and that multiple bank directories may be present in the RAM 26. For example, one bank might be the sound data appropriate for the instruments of a jazz band while another bank might the sound data for up to 128 instruments appropriate for a symphony.

Figure 3:
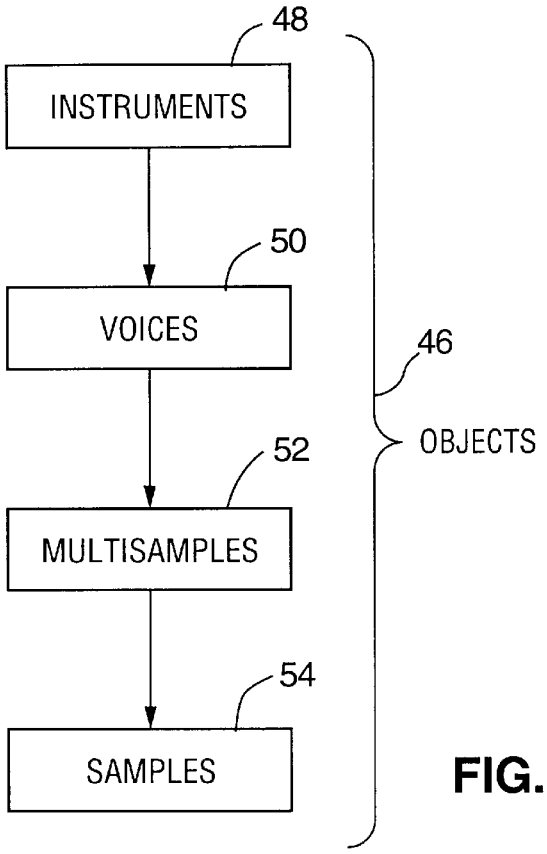
FIGS. 3, 4, and 5 are illustrations for use in explaining the organization of the synthesized voice data utilized by the software sound synthesis system shown in FIG. 1.

At step S3, the CPU 16 determines the objects for the particular instrument to be loaded. The objects can be thought of as blocks of memory which can be kept track of by the use of caches. Referring to FIG. 3, an object block 46 can be an instrument block 48, a voice block 50, a multisample block 52 or a sample block 54. Each of the blocks 48 to 54 in FIG. 3 represents a different cache in memory related to the same instrument. The specified instrument data block 48 further points to a voice data block 50. The voice data block 50 qualifies the data for the instrument by specifying which of the sound synthesis algorithms is best employed to generate that instrument's sound, e.g. by a wavetable algorithm, an FM algorithm, etc., as the case may be. The designation of the best algorithm for a particular instrument, in the present invention, has been predetermined empirically, however, in other embodiments the user can be asked to choose which synthesis algorithm is to be used for the instrument or can choose the algorithm interactively by trial and error. Also included in the voice data are references to certain qualifying parameters referred to herein as multisamples 52.

The multisamples 52 specify key range, volume, etc. for the particular instrument and point to the samples 54 of pulse code modulated (PCM) wave data stored for that particular instrument. As will be explained in greater detail hereinafter, it is this PCM data which is to be processed according to the particular sound synthesis algorithm which has been specified in the voice data 50.

Figure 4:
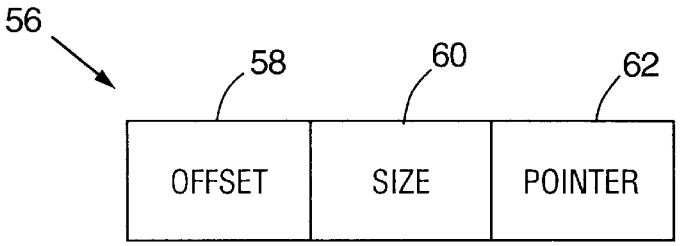
Figure 5:
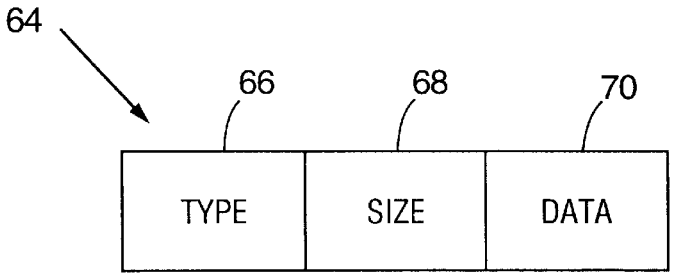

Referring to FIGS. 4 and 5, the organization of the objects 46 will be explained. The CPU 16 references objects by referring to an object information structure 56 which is organized into an offset entry 58, a size entry 60, and a data pointer 62. The offset entry 60 is the offset address of the object from the beginning of the file which is being loaded into memory. The size entry 60 has been precalculated and denotes the file size. These two entries enable the CPU 14 to know where to fetch the data from the files stored in the HDD 24 and how big the buffer must be which is allocated for that object. When the object is loaded from the HDD 24 into RAM 26, the pointer 62 will be assigned to the address in buffer memory where the object has been stored.

The object header 64 is the structure in the original file on the HDD 24 at the offset address 58 from the beginning of the file. It is constituted of a type entry 66, which may denote an instrument designation, a voice designation, a multisample designation, or a sample designation, i.e. it denotes the type of the data to follow, a size entry 68 which is the same as the size entry 64, i.e. it is the precalculated size of the data file, and lastly, the data 70 for the type, i.e. the data for the instrument, voice, multisample, or sample.

Referring again to FIG. 2, after step S3, the CPU 16 at step S4 checks if a particular object for the MIDI command has been loaded. The CPU 16 can readily do this by reviewing the object information entries and checking the list of offsets in a cache. If the object has been loaded, the CPU 16 returns to step S3. If not, the CPU 16 proceeds to step S5.

At step S5 the CPU 16 makes a determination of whether sufficient contiguous RAM is available for the object to be loaded. If the answer is affirmative, the CPU 16 proceeds to step S7 where sufficient contiguous memory corresponding to the designated size 64 of the data 70 is allocated. Thereafter at step 58 the CPU 16 loads the object from the HDD 24 into RAM 26, i.e. loads the data 70, determines at step S9 if all of the objects have been loaded and, if so, ends the routine. If all of the objects have not been loaded, the CPU 16 returns to step S3.

At step S5, if there is a negative determination, i.e. there is insufficient contiguous memory available, then it becomes necessary at step S6 to purge objects from memory until sufficient contiguous space is created for the new object to be loaded. Thereafter, the CPU proceeds to step S7.

Figure 6:
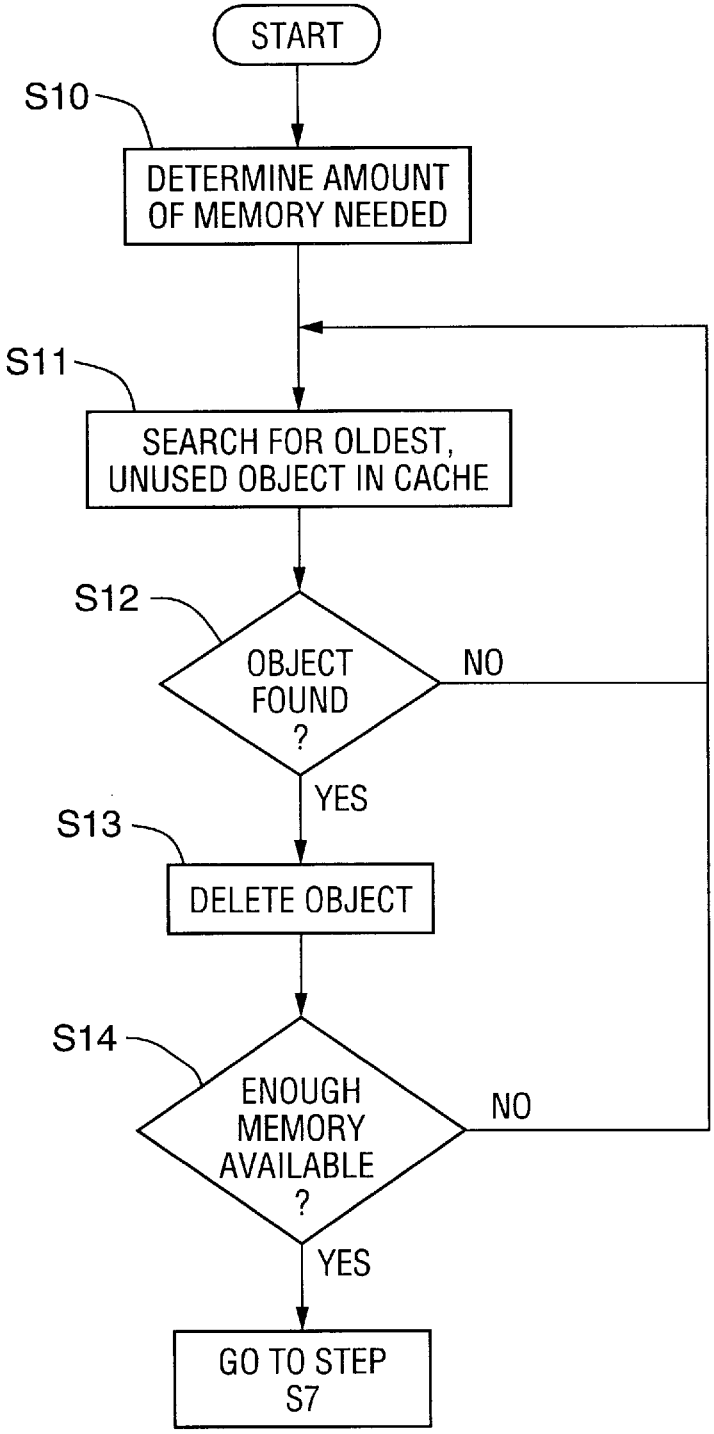
FIG. 6 is a flow chart for a PURGING OBJECTS subroutine performed by the central processor shown in FIG. 1.

In FIG. 6 the PURGING OBJECTS subroutine performed by the CPU 16 at step S6 is shown. At step S10 the CPU 16 determines the amount of contiguous memory needed by comparing the size entry 64 of the object information structure to the available contiguous memory. At step S11, the CPU 16 searches the cache in RAM 26 for the oldest, unused object. At step S12, the CPU 16 determines if the oldest object has been found. If not, the CPU 16 returns to step S11. If yes, the CPU 16 moves to step S13 where the found object is deleted. At step S14 the CPU 16 determines if enough contiguous memory is now available. If not, the CPU returns to step S11 and finds the next oldest, unused object to delete. Note that both criteria must be met, i.e. that the object is not in repeated use and is the oldest. If the CPU 16 finally provides enough contiguous memory by the steps S11–S14, the CPU 16 then proceeds to step S7 and the loading of the objects from the HDD into the RAM 26.

Figure 7:
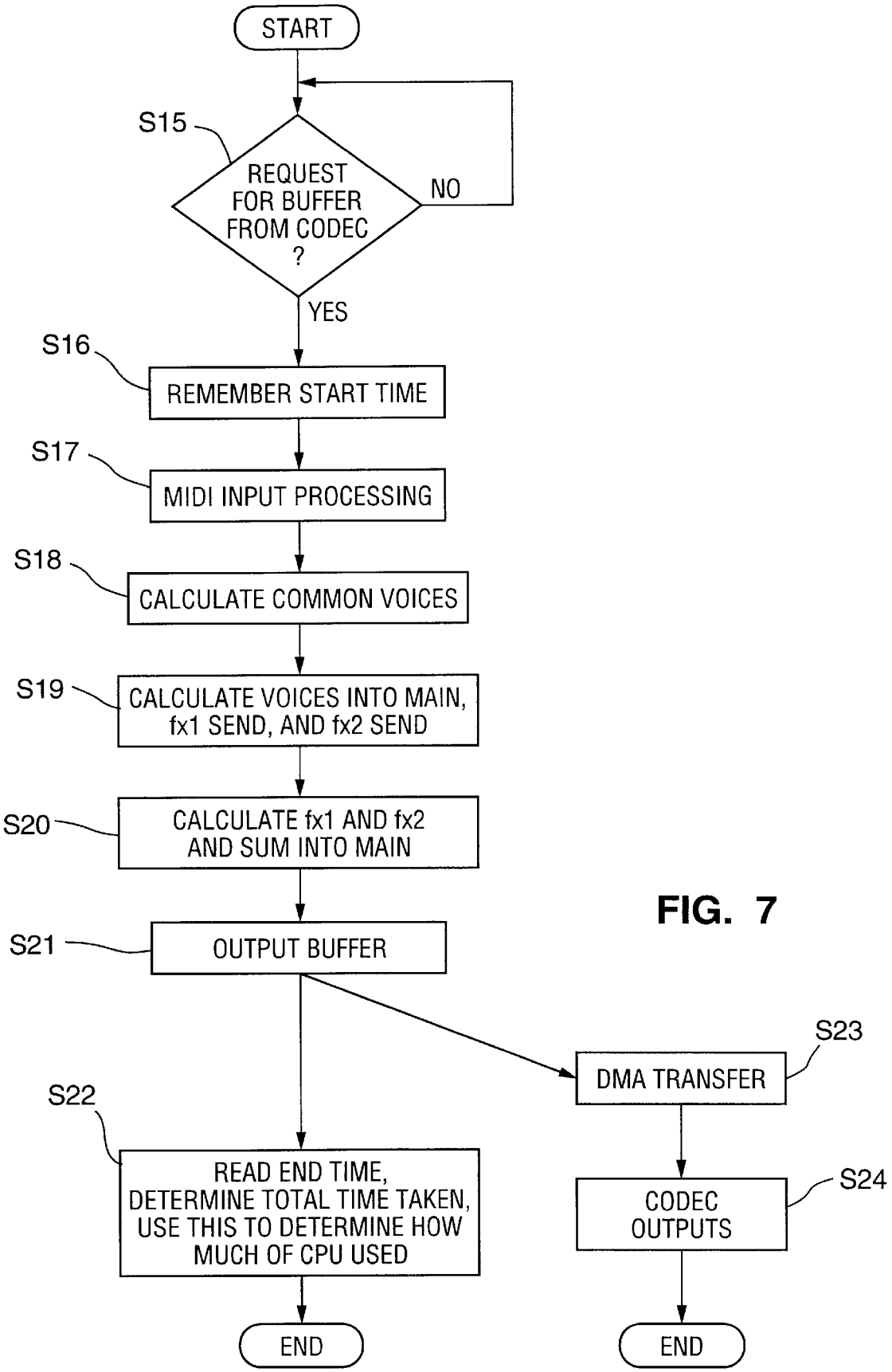
FIG. 7 is a flow chart for a VOICE PROCESSING routine performed by the central processor shown in FIG. 1.

During real time processing, i.e. when MIDI commands are generated to the CPU 16, the VOICE PROCESSING routine is performed by the CPU 16. Referring to FIG. 7, this routine is driven by the demands from the CODEC 18, i.e. as the CODEC outputs sounds it requests the CPU 16 to supply musical sound data to a main output buffer in RAM 26. At a first step S15, a determination is made whether the CODEC has requested that more data be entered into the main buffer. If not, the CPU 16 returns to step S15, or more accurately, proceeds to perform other processes.

If the determination at step S15 is affirmative, the CPU 16 sets a start time in memory at step S16 and begins real time processing of the MIDI commands at step S17. The MIDI INPUT PROCESSING subroutine performed by the CPU 16 will be explained subsequently in reference to FIG. 8, however, for the moment it is sufficient to explain that the MIDI INPUT PROCESSING subroutine activates voices to be calculated by a designated algorithm for each instrument note commanded by the MIDI input commands.

In step S18, the CPU 16 calculates "common voices," by which is meant certain effects which are to be applied to more than one voice simultaneously, such as vibrato or tremolo, for example, according to controller routings set by the MIDI INPUT PROCESSING subroutine. At step S19, the CPU 16 actually calculates voices, including common voices, for each instrument note using a CALCULATE VOICE subroutine, which will be explained further in reference to FIG. 10, to produce synthesized voice digital data which is loaded into a main buffer, a first special effects (f×1) buffer, and a second special effects (f×2) buffer.

At step S20, using the data newly loaded to the f×1 buffer and the f×2 buffer, the CPU 16 calculates special effects for some or all of the voices, e.g. reverberation, spatialization, equalization, localization, or chorusing, for example, by means of known algorithms and sums the resulting digital data in the main buffer. The special effects parameters are determined by the user. At step S21, the CPU 16 outputs the contents of the main buffer to, e.g. the DMA buffer portion of the circuit 18 at step S23. The data is transferred from the DMA buffer to the CODEC at step S24 and is audibly reproduced by the system 20. In some PC's, however, this transfer of the main buffer contents to the CODEC would be accomplished by a system call, for example.

Following step S21, the CPU 16 also reads the end time for executing the VOICE PROCESSING routine, determines, by taking the difference from the time read at step S16 the total elapsed time for completing the routine, and from this information determines the percentage of the CPU's available processing time which was required. This is accomplished by knowing how often the CPU 16 is called upon to fill and output the main buffer, e.g. every 20 milliseconds. So, if the total elapsed time to fill and output the main buffer is determined to be, e.g. two milliseconds, the determination is then made at step S22 that 10% of the CPU's processing time has been used for the voice synthesizing program and 90% of the processing time available to the CPU is available to perform other tasks. As will be explained later in this specification, at a predetermined limit which can be selected by the user, the sound synthesis will be gracefully degraded so that less of the CPU's available processing time is required. The VOICE PROCESSING routine is then ended until the next request is received from the CODEC.

Figure 8:
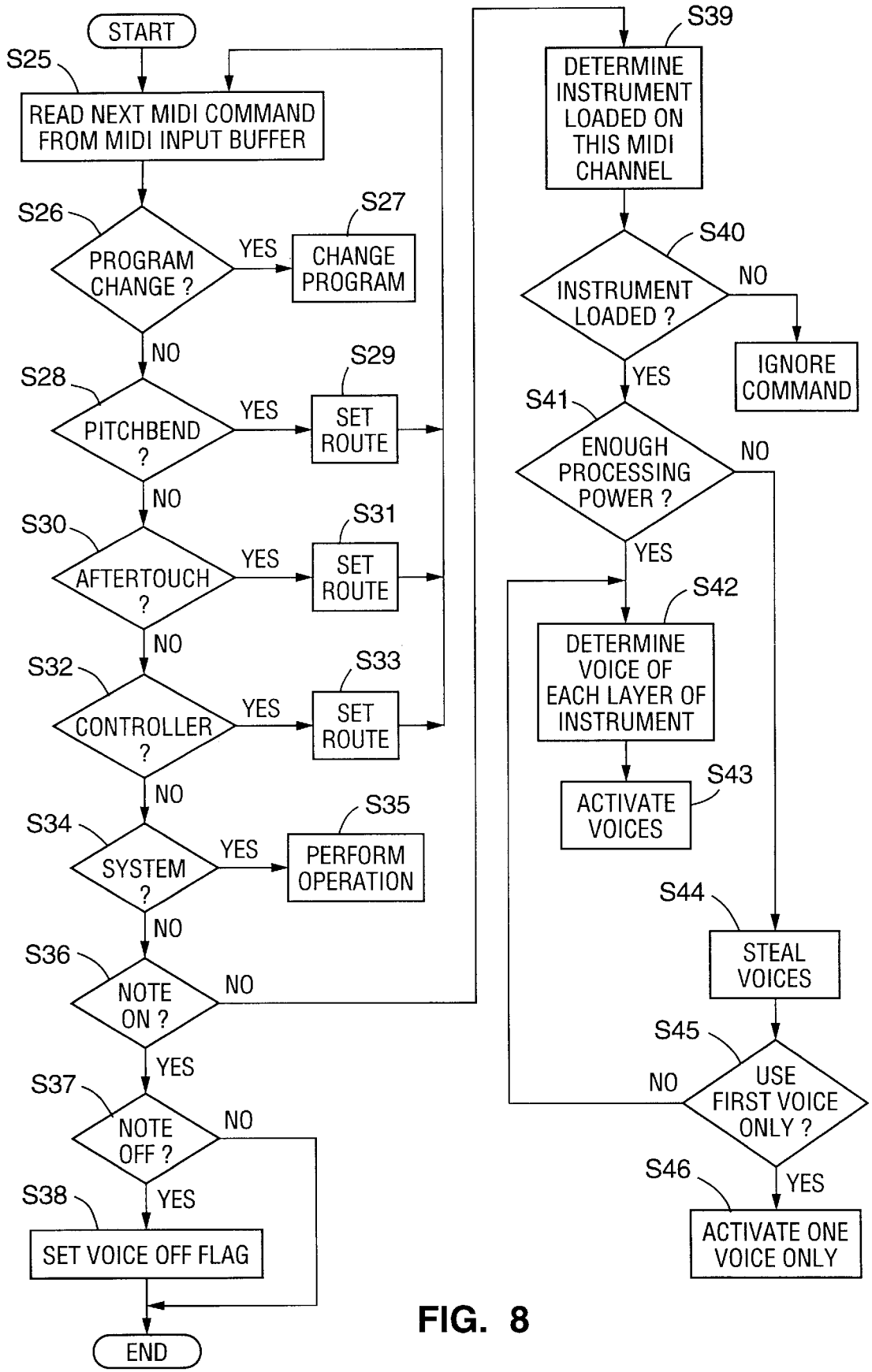
FIG. 8 is a flow chart for a MIDI INPUT PROCESSING subroutine performed by the central processor shown in FIG. 1.

Referring now to FIG. 8, the MIDI INPUT PROCESSING subroutine which is called at step S17 will now be explained. MIDI commands arrive at the CPU 16 asynchronously and are cued in a circular input buffer (not shown). At the first step S25, the CPU 16 reads the next MIDI command from the MIDI input buffer. The CPU 16 then determines at step S26 if the read MIDI command is a program change. If so, the CPU 16 proceeds to make a program change at step S27, i.e. performs step S1 of FIG. 2. The CPU determines in the next series of steps whether the MIDI command is one of several different types which may determine certain characteristics of the voice. If one of such commands is detected, a corresponding controller routing to an appropriate algorithm is set which will be used during the ACTIVATE VOICE subroutine. That is, algorithms which use as one modulation input that particular controller are updated to use that controller during the ACTIVATE VOICE subroutine. Such routing will now be explained.

A "routing" is a connection form a "modulation source" to a "modulation destination" along with an amount. For example, a MIDI aftertouch command can be routed to the volume of one of the voice algorithms in an amount of 50%. In this example, the modulation source is the aftertouch command and the modulation destination is the particular algorithm which is to be affected by the aftertouch command. There is always a default routing of a MIDI note to pitch. Some possible routings are given in the table below:

TABLE I

| Modulation Sources | Modulation Destinations |
|---|---|
| MIDI Note | Pitch |
| MIDI Velocity | Volume |
| MIDI Pitchbend | Pan |
| MIDI Aftertouch | Modulation Generator Amplitude |
| MIDI Controllers | Modulation Generator Parameter[1] |
| Modulation Generator - Envelope | Algorithm Specific[2] |
| Modulation Generator - Low Frequency Oscillator (LFO) | Algorithm Specific[2] |
| Modulation Generator - Random | Algorithm Specific[2] |

[1]For envelope: attack, decay, sustain, release. For LFO: speed. For random: filter.
[2]For PCM synthesis algorithm: sample start, filter cutoff, filter resonance. For FM synthesis algorithm: operator frequency, operator amplitude. For analog synthesis algorithm: oscillator frequency, oscillator amplitude, filter cutoff, filter resonance. For physical modeling (PM) - clarinet: breath, noise filter, noise amplitude, reed threshold, reed scale, filter feedback.

A Modulation Generator Envelope is the predetermined amplitude envelope for the attack, decay, sustain, and release portion of the note which is being struck and can modulate not only volume but other effects, e.g. filter cutoff, as well. Note, that it is possible to have different envelopes with different parameters.

Each voice has a variable number of routings. Thus, an algorithm can be controlled in various ways. For a PCM synthesized voice, a typical routing might be:

Velocity routed to Volume Modulation Generator Envelope routed to Volume For an analog synthesized voice, a typical routing might be:

Velocity routed to Volume

Modulation Generator Envelope routed to Volume

Modulation Generator Envelope routed to Filter Cutoff.

Referring again to FIG. 8, assuming there is no program change detected, the CPU 16 proceeds to step S28 to detect if there is a pitchbend command. A pitchbend is a command from the keyboard 10 to slide the pitch for a particular voice or voices up or down. If a pitchbend command is detected, a corresponding pitchbend modulation routing to relevant algorithms which use pitchbend as an input is set at step S29. If no such command is detected, the CPU proceeds to step S30 where it is detected if an aftertouch command has been received. An aftertouch command denotes how hard a key on the keyboard 10 has been pressed and can be used to control certain effects such as vibrato or tremolo, for example, which are referred to herein as common voices because they may be applied in common simultaneously to a plurality of voices. If an aftertouch command is detected, a corresponding aftertouch modulation routing to relevant algorithms which use aftertouch as an input is set at step S31.

If no such command is detected, the CPU proceeds to step S32 where it is detected if a controller command has been received. A controller command can be, for example a "mod wheel," volume slider, pan, breath control, etc. If a controller command is detected, a corresponding controller modulation routing to relevant algorithms which use a controller command as an input is set at step S33. If no such command is detected, the CPU proceeds to step S34 where it is determined if a system command has been received. A system command could pertain to timing or sequencer controls, a system reset, which causes all caches to be purged and the memory to be reset, or an all notes off command. If a system command is detected, a corresponding action is taken at step S35. After each of steps S29, S31, and S33, the CPU 16 returns to step S25 for further processing.

If no such command is detected, the CPU proceeds to step S36 where it is determined if the command is a "note on," i.e. a note key has been depressed on the keyboard 10. If not, the CPU proceeds to step S37 where it is determined if the command is a "note off," i.e. a keyboard key has been released. If not, the CPU proceeds to the end. If a note off command is received, the CPU 16 sets a voice off flag at step S38.

If, at step S36, the CPU 16 determines that a note on command has been received, the CPU 16 proceeds to step S39 where it detects the type of instrument being called for on this MIDI channel. At step S40 the CPU 16 determines if this instrument is already loaded. If not, the command is ignored because, in real time, it is not possible to load the instrument from the HDD 24.

If the determination at step S40 is affirmative, the CPU determines next at step S41 if there is enough processing power available by utilizing the results of step S22 of previous VOICE PROCESSING routines.

Assuming the determination at step S41 is yes, at step S42 the CPU 16 determines the voice on each layer of the instrument. By this is meant that in addition to producing the sound of a single instrument for a command on a channel, the sound on a channel can be "layered" meaning that the "voices", or sounds, of more than one instrument are produced in response to a command on the channel. For example, a note can be generated as the sound of a piano alone or, with layering, both a piano and string accompaniment. Next, the CPU 16 activates the voices by running the subroutine shown in FIG. 9 at step S43.

If, however, the CPU 16 finds insufficient processing power available. at step S41 the CPU runs a STEAL VOICES subroutine at step S44. In the STEAL VOICES subroutine the CPU 16 determines which is the oldest voice in the memory cache and discards it. In effect, the note is dropped. Alternatively, the CPU 16 could find and drop the softest voice, the voice with the lowest pitch, or the voice with the lowest priority, e.g., a voice which was not producing the melody or which represents an instrument for which a dropped note is less noticeable. A trumpet, for instance, tends to be a lead instrument, whereas string sections are generally part of the background music. In giving higher priority to commands from a trumpet at the expense of string section commands, it is the background music that is affected before the melody.

At the next step S45, the CPU 16 determines, based on the processing power available, whether nor not to use the first voice only, i.e. to drop all other layered voices for that instrument. If not, the CPU 16 returns to step S42. If the decision is yes, the CPU 16 proceeds to step S46 where it activates only one voice using the ACTIVATE VOICE subroutine of FIG. 9.

Figure 9:
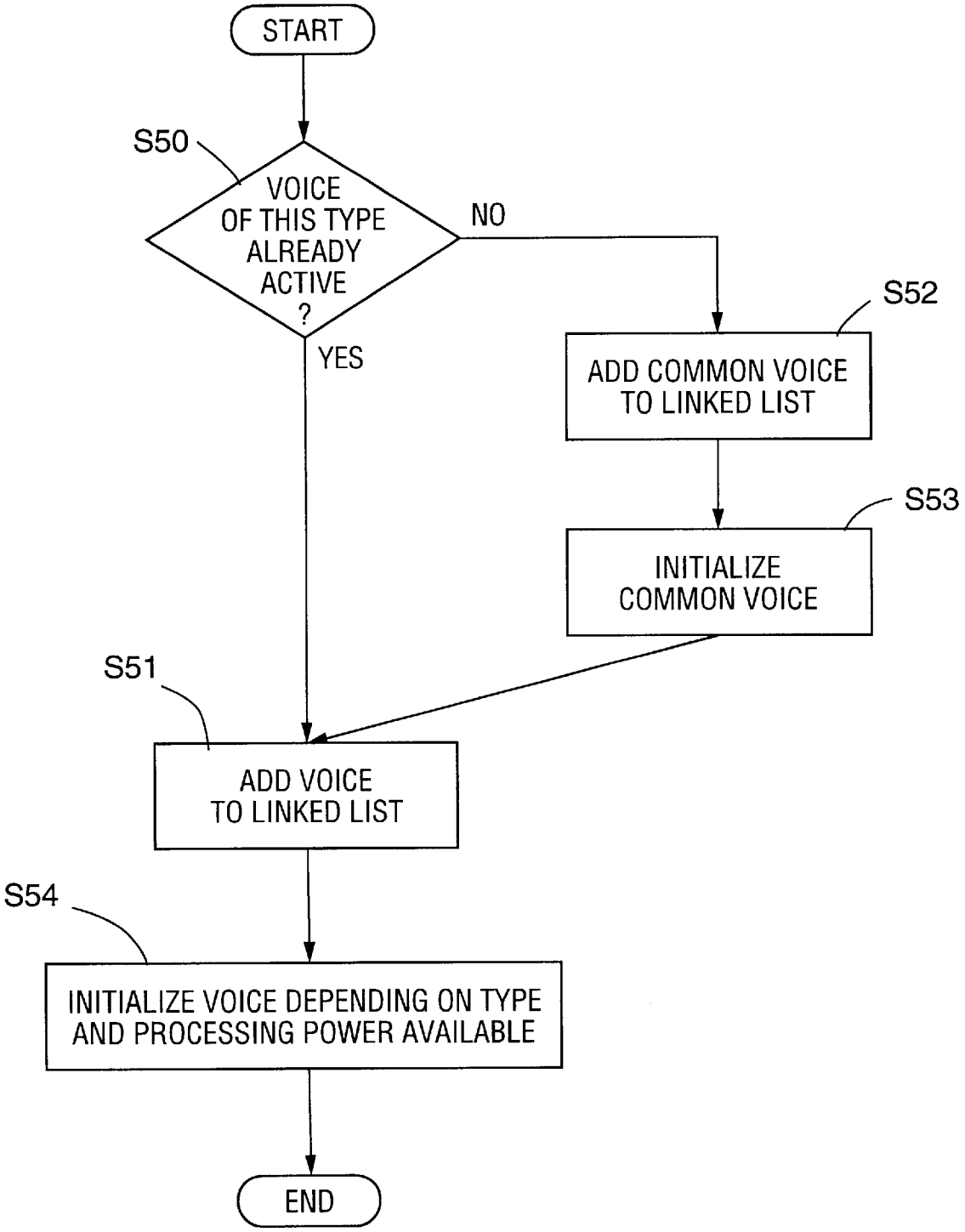
FIG. 9 is a flow chart for an ACTIVATE VOICE subroutine performed by the central processor shown in FIG. 1.

Referring now to FIG. 9, in the ACTIVATE VOICE subroutine, the CPU 16 determines at step S50 whether or not a voice of this type is already active. If so, the CPU adds the voice to a "linked list" at step S51. The concept of the linked list will be explained further herein in reference to FIG. 11. If the decision in step S50 is no, the CPU 16 adds a common voice, e.g. tremolo or vibrato, to the linked list at step S52, initializes the common voice at step S53, and proceeds to step S51.

Following step S51, at step S54, the CPU 16 initializes the voice depending on the type and the processing power which was determined at step S22 in previous VOICE PROCESSING routines. If insufficient CPU processing time is available, the CPU 16 changes the method of synthesis for the note. The algorithm for physically modeling an instrument, for instance, requires a large number of calculations. In order to reduce the resources required, or to produce the tone in the time frame requested for it, the tone that is requested may be produced using a less resource intensive algorithm, such as analog synthesis.

Also, some algorithms can be pared down to reduce the time and resources required to generate a tone. The FM synthesis algorithm can use up to 4 stages of carrier-modulation pairs. But, a lower quality tone can be produced with only 2 stages of synthesis to reduce the time and resources required. For analog, which employs algorithms simulating multiple oscillators and filter elements, the number of simulated "oscillators" or "filter sections" can be reduced.

Finally, to cope with the situation where none of the strategies above proves adequate, a set of waveform default tones is preloaded into cache. When no better value can be generated for the tone because of limitations on available CPU processing power, the default value is used so that at least some sound is produced in response to a tone command rather than dropping the note altogether.

Figure 11:
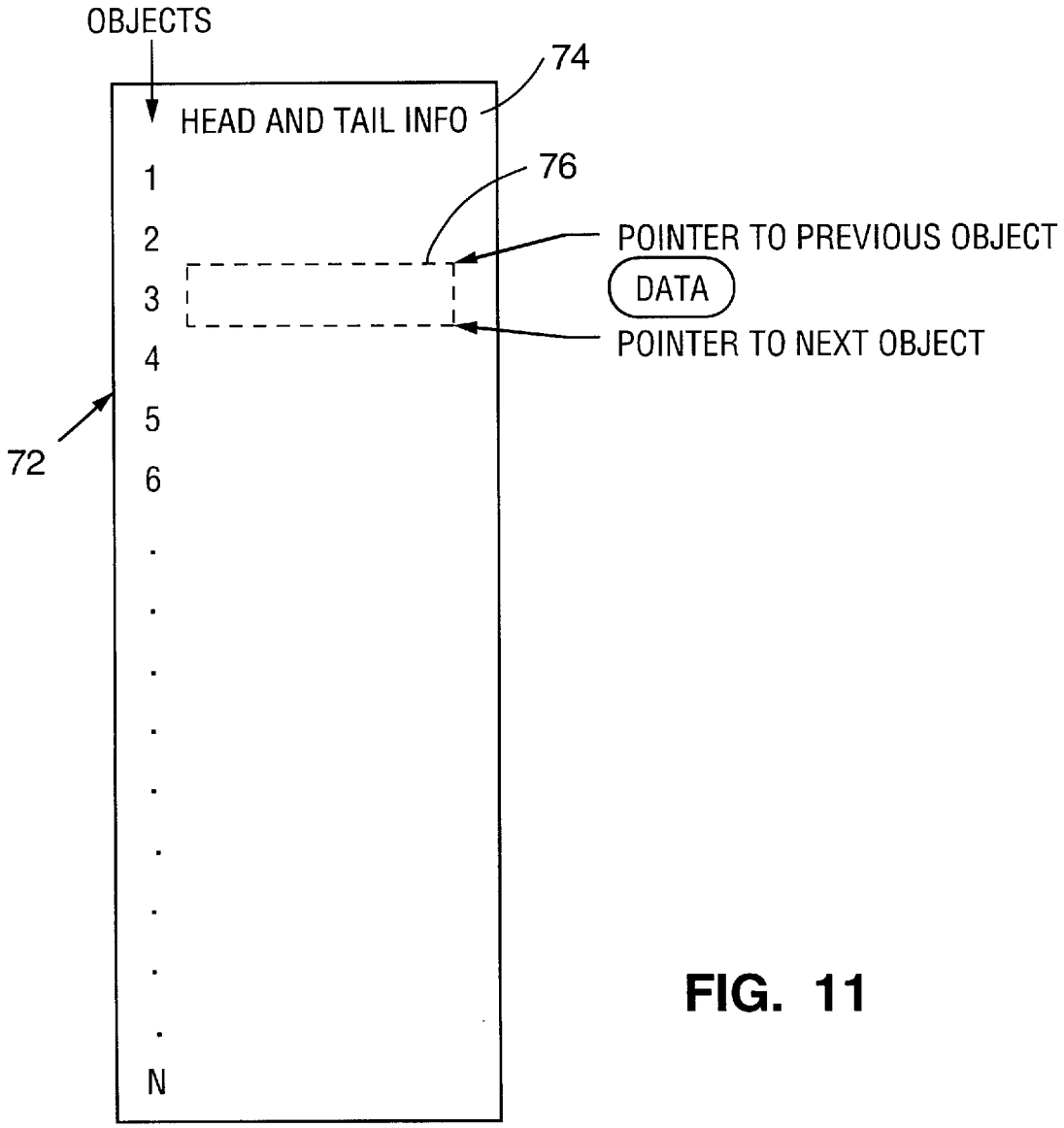
FIG. 11 is an illustration for use in explaining the organization of a linked list.
Figure 12:
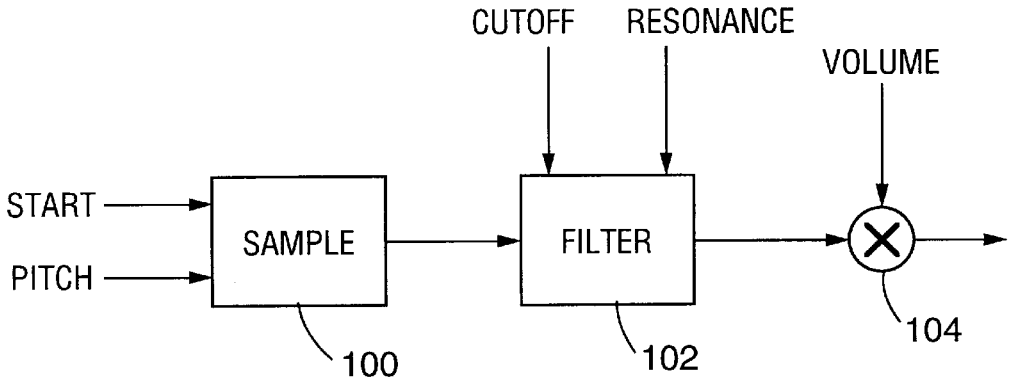
(PRIOR ART) FIG. 12
FIG. 12 is an illustration for explaining the operation of a PCM algorithm
Figure 13:
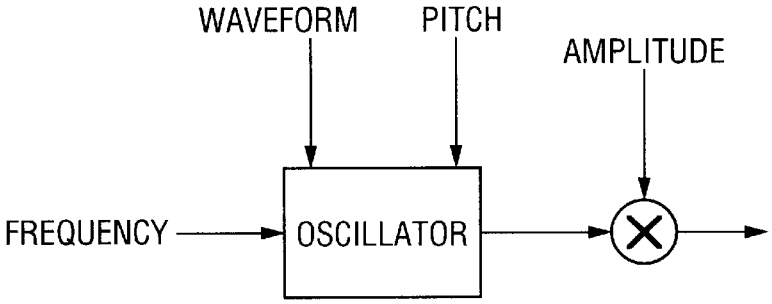
(PRIOR ART) FIG. 13
FIGS. 13–15 are illustrations for explaining the operation of an FM algorithm
Figure 14:
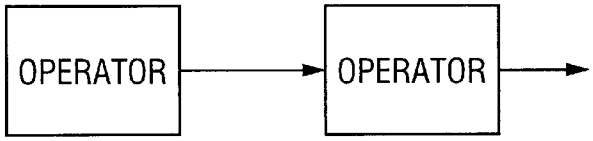
(PRIOR ART) FIG. 14
Figure 15:
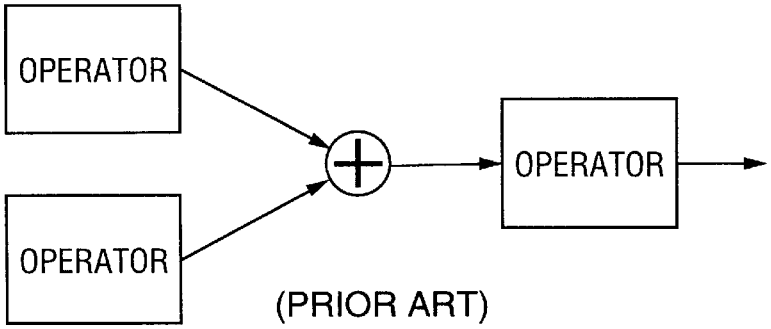
(PRIOR ART) FIG. 15
Figure 16:
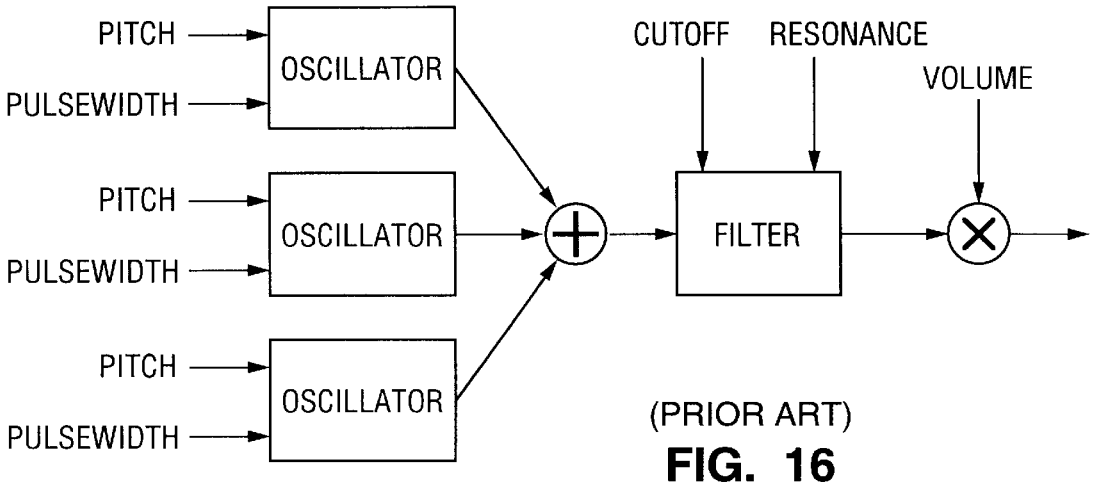
(PRIOR ART) FIG. 16
FIG. 16 is an illustration for explaining the operation of an analog algorithm
Figure 17:
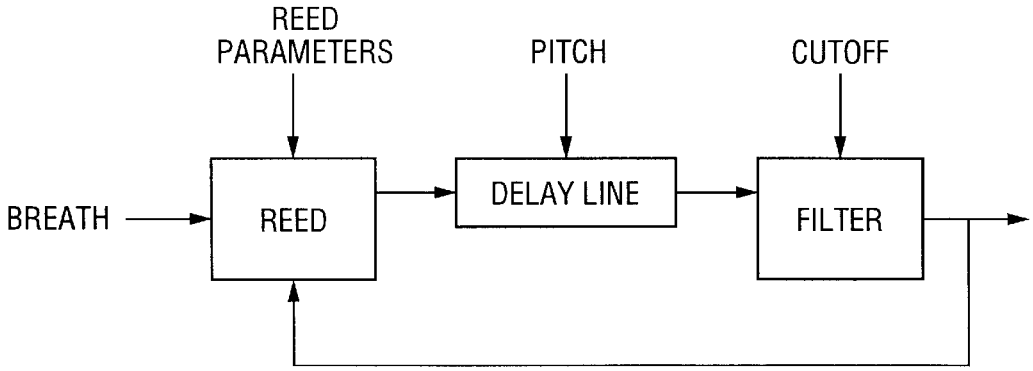
(PRIOR ART) FIG. 17
FIG. 17 is an illustration for explaining the operation of a physical model—clarinet algorithm.

The concept of the linked list will be explained now in reference to FIG. 11. Each list element represents a note to be played. The contents of the output sound main buffer are generated by processing each list element into a corresponding Pulse Code Modulation (PCM) data and adding it to the main buffer. The addition of layers or channels is accommodated by merely adding an additional list element for the voice note. For example, a channel with a note in three voices results in three elements in the list, one for each voice. The linked list is used for more than just the active voices. There are also lists of objects for each of the caches: instruments, voices, multisamples, and samples. There are also lists for free memory buffers in a memory manager (not shown).

Each list element contains data which specifies the processing function for that element. For example, an element for a note that is to be physically modeled will contain data referring to the physical model function. By using this approach, no special processing is required for layered voices.

The CPU 16 handles the objects in the form of linked lists which are stored in a buffer memory 72. Each linked list comprises a series of N (where N is an integer) non-consecutive data entries 76 in the buffer memory 72. A first entry 74 in the buffer memory 72 represents both the address ("head") in RAM of the beginning of the first object of the linked list and the address ("tail") of beginning of the last object of the linked list, i.e. the last object in the linked list, not the last in terms of entries in the buffer memory.

The linked list structure gives the software enormous flexibility. The linked list can be expanded to any length that can be accommodated by the available system resources. The linked list structure also allows the priority strategies discussed above to be applied to all the notes to be played. And finally, if additional synthesis algorithms are developed, the only program modification required to accommodate the new algorithm is a pointer to a new synthesis function. The basic structure of the software does not require change.

Each entry 76, i.e. object, in the linked list stored in the buffer memory includes data, a pointer to the buffer memory address of the previous object and a pointer to the buffer memory address of the next object. When one object 76 is deleted from the buffer 72 for some reason, then the pointers of the objects 76 preceding the removed object 76 and succeeding the removed object 76 must be revised accordingly. When a new object is added to the linked list, the CPU 16 refers to the tail address to find the prior last object, updates that object's "pointer to next object" to refer to the beginning address of the newly added object, adds the former tail address as the "pointer to previous object" to the newly added object, and updates the tail address to reference this address of the newly added object.

Figure 10:
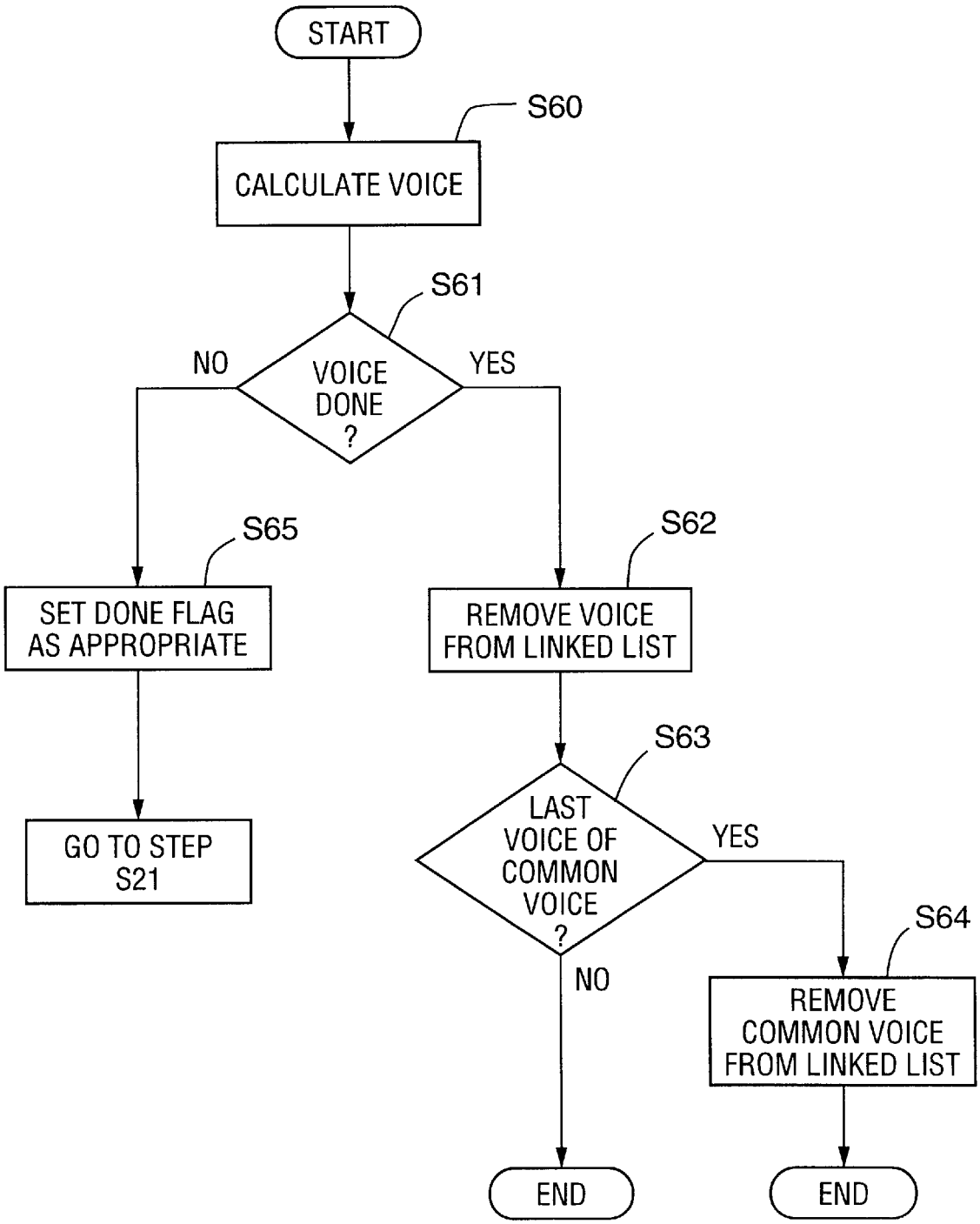
FIG. 10 is a flow chart for a CALCULATE VOICE subroutine performed by the central processor shown in FIG. 1.

Referring to FIG. 10, the CALCULATE VOICE(s) subroutine called at step S18 of the VOICE PROCESSING routine of FIG. 7 will now be explained. It will be recalled that at step S54 of the ACTIVATE VOICE subroutine, the voices are initialized, i.e. the appropriate sound synthesis algorithm 30 is selected. At step S60, the sound for each activated voice is calculated to generate voice digital data. After the voice calculation processing, if the voice is not done at step S61, the CPU 16 proceeds to step S65 to set a done flag and then to step S21 of the VOICE PROCESSING routine. However, if the voice is done, from step S61 the CPU 16 proceeds to step S62 where the voice is removed from the linked list. At the next step S63, the CPU 16 determines if the voice is the last voice of the common voice. If not, the process ends. If it is, the CPU 16 removes the common voice from the linked list at step S64 and ends the routine.

The software synthesis system of the present invention permits high quality audio sound to be generated using a standard PC with a CODEC. The system is dynamically configurable to accommodate different levels of CPU performance, available memory and desired sound quality. The software structure is easily adaptable to new developments in sound synthesis technology.

Although the present invention has been shown and described with respect to preferred embodiments, various changes and modifications which are obvious to a person skilled in the art to which the invention pertains are deemed to lie within the spirit and scope of the invention as claimed.

What is claimed is:

1. An audio signal processing system comprising:

input means for inputting musical instrument digital interface (MIDI) commands in real time over a plurality of channels;

personal computer means including a central processing unit (CPU) supplied with the MIDI commands for simultaneously synthesizing one or more voices for each of the channels in response to the MIDI commands, each of the voices being generated by one or more audio synthesis algorithms executed in software by the CPU;

random access memory means (RAM) for storing digital voice data representative of each of the voices generated by the CPU; and output means for audibly reproducing the voices from the digital voice data stored in the RAM, wherein the CPU, in generating the voices, selectively diminishes the complexity of the processing of a selected audio synthesis algorithm as the processing time available to the CPU diminishes due to processing demands of other operations being performed by it.

2. An audio signal processing system according to claim 1, further wherein the CPU, in generating the voices further processes the digital voice data by special effects processing, including one or more of reverberation, spatialization, equalization, and chorusing processing.

3. An audio signal processing system according to claim 1, wherein:

the CPU selects the audio synthesis algrithm whose processing complexity is to be diminished based on the type of voice to be generated.

4. An audio signal processing system according to claim 2, wherein:

the CPU selects the audio synthesis algorithm whose processing complexity is to be diminished based on the type of voice to be generated.

5. An audio signal processing system comprising:

input means for inputting musical instrument digital interface (MIDI) commands in real time over a plurality of channels;

computer means including a central processing unit (CPU) supplied with the MIDI commands for simultaneously synthesizing one or more voices for each of the channels in response to the MIDI commands, each of the voices being generated by one or more of a plurality of predefined audio synthesis algorithms, including a wavetable algorithm, a frequency modulation algorithm, an analog algorithm, and a physical model algorithm executed in software;

random access memory means (RAM) for storing digital voice data representative of each of the voices generated by the CPU; and output means for audibly reproducing the voices from the digital voice data stored in the RAM, wherein the CPU, in generating the voices, selectively diminishes the complexity of the processing of a selected audio synthesis algorithm as the processing time available to the CPU diminishes due to processing demands of other operations being performed by it.

6. An audio signal processing system according to claim 5, wherein:

the CPU, in generating the voices further processes the digital voice data by special effects processing, including one or more of reverberation, spatialization, equalization, and chorusing processing.

7. An audio signal processing system according to claim 5, wherein:

the CPU selects the audio synthesis algorithm whose processing complexity is to be diminished based on the type of voice to be generated.

8. An audio signal processing system according to claim 7, further wherein the CPU, in generating the voices further processes the digital voice data by special effects processing, including one or more of reverberation, spatialization, equalization, and chorusing processing.

* * * * *